US011744300B2

(12) United States Patent
Gharagyozyan

(10) Patent No.: US 11,744,300 B2
(45) Date of Patent: Sep. 5, 2023

(54) WRAP FOR FOOT AND METHOD OF WRAPPING WITH THE SAME (VARIANTS)

(71) Applicant: Karine Gharagyozyan, Yerevan (AM)

(72) Inventor: Karine Gharagyozyan, Yerevan (AM)

( * ) Notice: Subject to any disclaimer, the term of this patent is extended or adjusted under 35 U.S.C. 154(b) by 0 days.

(21) Appl. No.: 16/641,651

(22) PCT Filed: Aug. 10, 2018

(86) PCT No.: PCT/IB2018/056035
§ 371 (c)(1),
(2) Date: Feb. 25, 2020

(87) PCT Pub. No.: WO2019/043486
PCT Pub. Date: Mar. 7, 2019

(65) Prior Publication Data

US 2021/0059328 A1 Mar. 4, 2021

(30) Foreign Application Priority Data

Aug. 31, 2017 (AM) ..... AM20170011U

(51) Int. Cl.
*A41D 13/06* (2006.01)

(52) U.S. Cl.
CPC ..... *A41D 13/06* (2013.01)

(58) Field of Classification Search
CPC ..... A41D 13/06; A44C 15/009; A61F 13/065; A61F 13/068
See application file for complete search history.

(56) References Cited

U.S. PATENT DOCUMENTS

| | | | | | |
|---|---|---|---|---|---|
| 1,594,908 | A * | 8/1926 | Stansell | A41D 17/04 | 602/62 |
| 1,637,285 | A * | 7/1927 | Sheehan | A61F 13/068 | 602/66 |
| 4,033,581 | A * | 7/1977 | Sheppard | A63B 69/002 | 473/438 |
| 4,566,447 | A * | 1/1986 | Deis | A61F 5/0113 | 602/28 |
| 9,532,616 | B2 * | 1/2017 | Gabka | A61F 13/065 | |
| 2009/0272009 | A1 * | 11/2009 | Weisner | A43B 13/203 | 36/102 |
| 2011/0010965 | A1 * | 1/2011 | Shepherd | A43B 7/20 | 36/114 |
| 2012/0204441 | A1 * | 8/2012 | Conner | A43B 3/103 | 36/11.5 |

(Continued)

*Primary Examiner* — Tajash D Patel

(57) ABSTRACT

The utility model relates to devices for wrapping feet when wearing shoes. One variant of the device is a band made of fabric having a mid-section and end sections, wherein said mid-section has a width of approximately half the length of the user's foot and a length approximately equal to the circumference of the Metatarsophalangeal joint area of the user's foot. The end sections, that are the lengthwise continuation of the mid-section, can have different shapes and are decoratively tied or otherwise arranged after the shoes are put on. Another variant of the device is a loop made of fabric formed by connecting the ends of a band having a width approximately half the length of the user's foot and a length approximately double the circumference of the Metatarsophalangeal joint area of the user's foot. The utility model provides protection and hygiene when wearing shoes.

9 Claims, 5 Drawing Sheets

(56) References Cited

U.S. PATENT DOCUMENTS

| | | | | |
|---|---|---|---|---|
| 2015/0374047 | A1* | 12/2015 | Gabka | A41B 11/12 2/455 |
| 2016/0317360 | A1* | 11/2016 | Crumbley | A61F 13/00085 |
| 2018/0125737 | A1* | 5/2018 | Raje | A61H 1/006 |
| 2019/0150522 | A1* | 5/2019 | Weiland | A41B 11/003 |
| 2021/0245030 | A1* | 8/2021 | Hackney | A63B 21/0552 |

* cited by examiner

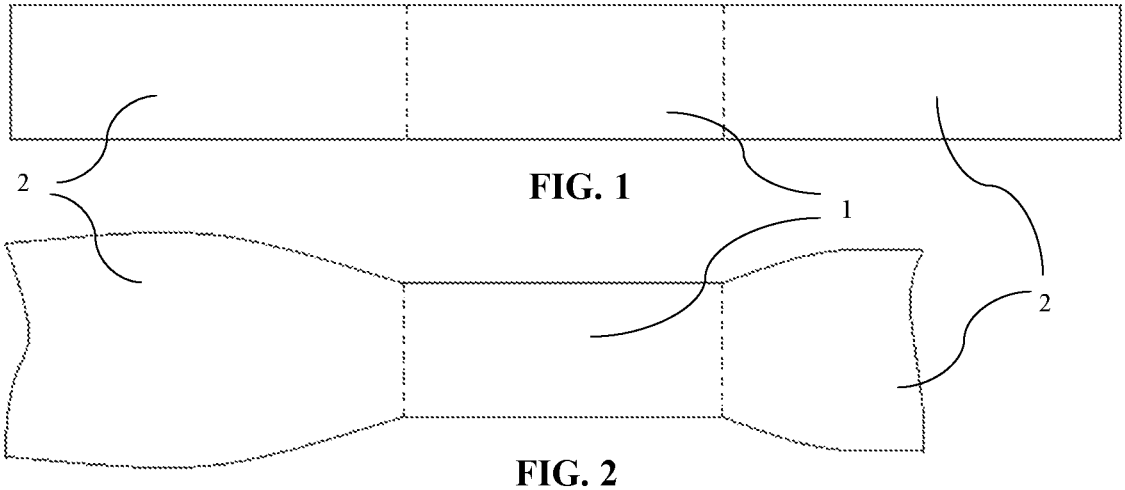
FIG. 1
FIG. 2
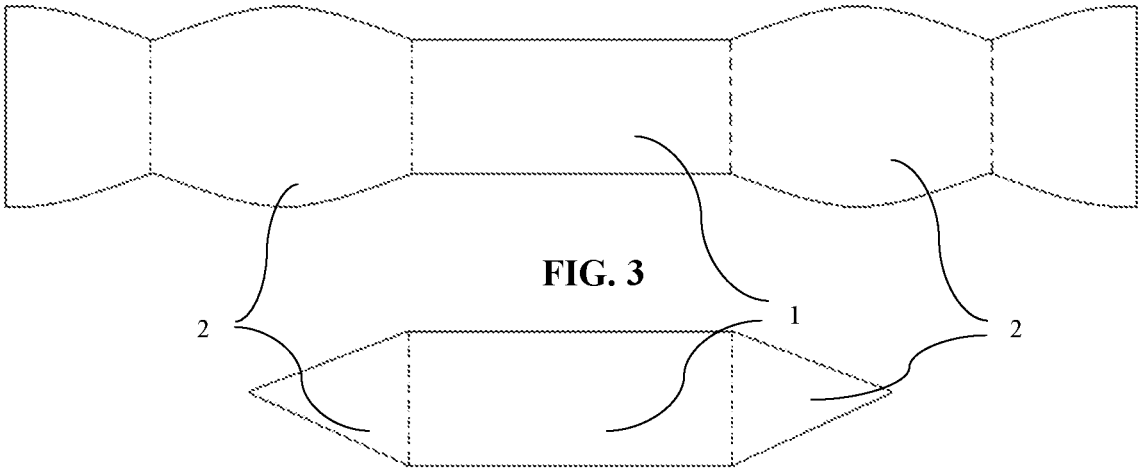
FIG. 3
FIG. 4
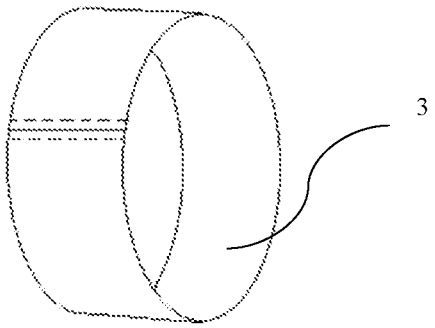
FIG. 5

WRAP FOR FOOT AND METHOD OF WRAPPING WITH THE SAME (VARIANTS)

FIELD OF INVENTION

The present utility model relates to the field of human needs, more particularly to wraps for feet and methods of wrapping one's feet with the same.

BACKGROUND OF THE INVENTION

When wearing shoes women often endure discomfort and pain, especially in the front part of the foot. Shoe material rubs against the skin and causes irritation and calluses. Additionally, when wearing shoes barefoot the sweat sullies the shoes and causes bacteria growth, while proper cleaning of inner soles of shoes is difficult and may damage shoe material.

Prior art solutions to mitigate this problem include local covers, hosiery, or socks. However, these options are often not sufficient or not favorable, because 1) women do not fancy the appearance of local covers and these protect only small areas, 2) women do not want to wear hosiery or socks during hot seasons or with pants, 3) sheer hosiery or socks are easily damaged, etc.

Prior art solutions also include a wrap for foot in the form of a band made of fabric, which is intended to protect the metatarsophalangeal junction area of the user's foot (U.S. Pat. No. 9,532,616). Here the band has two connected surfaces, wherein the first surface, which is in contact with users' foot is made of soft material, and the second surface is intended to prevent sliding.

Said solution protects only the metatarsophalangeal junction area of feet and hence is a local cover that does not protect the toe area. Also, the said band has a certain appearance, which especially with open summer shoes can be associated with a medical bandage.

SUMMARY OF THE INVENTION

The general objective of the present utility model is to protect the toes and Metatarsophalangeal (MTP) joint area of the user's feet, providing comfort and hygiene to feet when wearing shoes, especially when wearing shoes barefoot.

Another general objective of the present utility model is to enhance or complement the look of one's shoes and overall attire.

To achieve said objectives, in accordance with the first general embodiment of the present utility model the wrap has a shape of a band which has a mid-section and elongated end sections, wherein said mid-section has a width of about half of the length of user's foot and the length of at least the circumference of the Metatarsophalangeal (MTP) joint area of user's foot.

For one embodiment of the first wrap, the end sections have a rectangular shape.

For another embodiment of the first wrap, the end sections are in the shape of trapezoids or triangles attached to the mid-section at the bases.

For another embodiment of the first wrap, the end sections are in the shape of one or more trapezoids with straight, convex or concave edges attached at their bases.

For another embodiment of the first wrap, the end sections are in the shape of one or more intersecting circles or ovals.

For another embodiment of the first wrap, the end sections are identical.

For another embodiment of the first wrap, the end sections are different.

For another embodiment of the first wrap, the end sections have wavy or zigzag edges.

For another embodiment of the first wrap the end sections represent any combination of the above alternatives.

The first wrap is preferably utilized in accordance with wrapping method, whereby the mid-section of the wrap is placed under the front part of the foot, perpendicular to the foot, after which the end sections are crossed at the top of the foot to cover the toes and the Metatarsophalangeal (MTP) joint area of user's foot. The user then slides the foot into the shoe leaving the end sections of the wrap outside the shoe. The end sections of the wrap are then decoratively tied or arranged.

In accordance with the second general embodiment of the present utility model, the wrap has a shape of a loop constructed by connecting two ends of a band, wherein said band has a width of about ½ of user's foot and the length of about twice the circumference of the Metatarsophalangeal (MTP) joint area of user's foot. Said loop is used to cover the toes and the Metatarsophalangeal (MTP) joint area of the user's foot.

The second wrap is preferably utilized in accordance with the wrapping method, whereby the loop is placed around the Metatarsophalangeal (MTP) joint area of the foot and twisted 360° to form a double loop in the form of figure eight, where one loop is around said area of the foot and the second is free. Then, the free loop is arranged around the toe area of the foot. When the shoe is put on, the knot which is formed by twisting the loop remains outside of the shoe, close to the topline of the shoe.

BRIEF DESCRIPTION OF THE DRAWINGS

Embodiments of the present utility model are illustrated in the drawings below.

FIG. 1 is a top plan view of the first wrap, wherein the end sections are analogous and have a rectangular shape.

FIG. 2 is a top plan view of the first wrap, wherein the end sections are different and have the shape of trapezoids with concave sides and wavy base.

FIG. 3 is a top plan view of the first wrap, wherein the end sections are analogous and have the shape of multiple trapezoids connected at bases.

FIG. 4 is a top plan view of the first wrap, wherein the end sections are analogous and have a triangular shape.

FIG. 5 is the perspective view of the second wrap having a shape of a loop made by connecting the ends of a ribbon.

FIG. 8 is the illustration of the third step of the wrapping method using the first wrap, where the shoe is put on.

DETAILED DESCRIPTION

Figure 6:
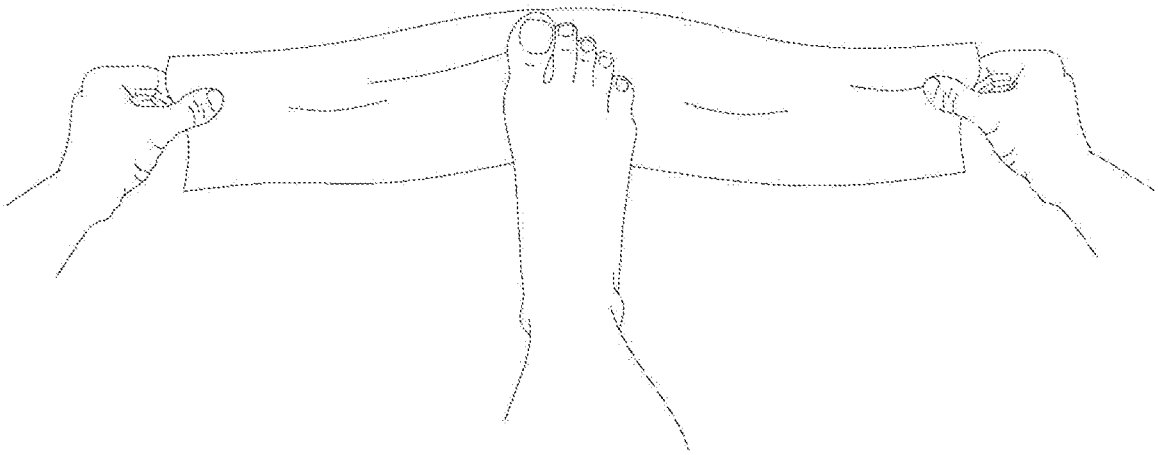
FIG. 6 is the illustration of the first step of the wrapping method using the first wrap, where the mid-section of the wrap is placed under the front part of the user's foot.
Figure 7:
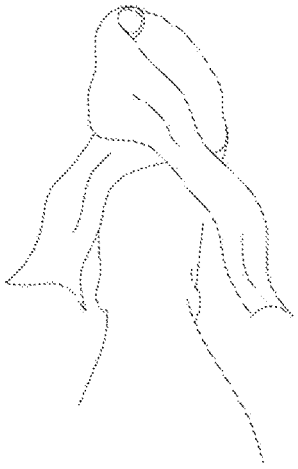
FIG. 7 is the illustration of the second step of the wrapping method using the first wrap, where the ends of the wrap are crossed at the top of the user's foot, as the mid-section is wrapped around the toes and the Metatarsophalangeal (MTP) joint area of user's foot.
Figure 8:
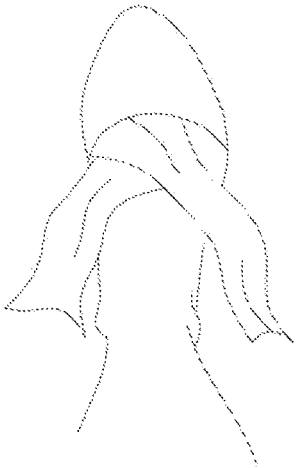
Figure 9:
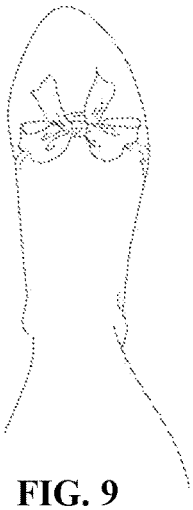
FIG. 9 is the illustration of the fourth step of the wrapping method using the first wrap, where the ends of the wrap are tied.
Figure 10:
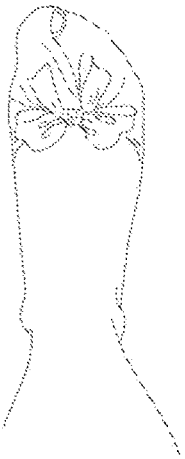
FIG. 10 is the top view of the user's foot wrapped using the first wrap without a shoe.
Figure 11:
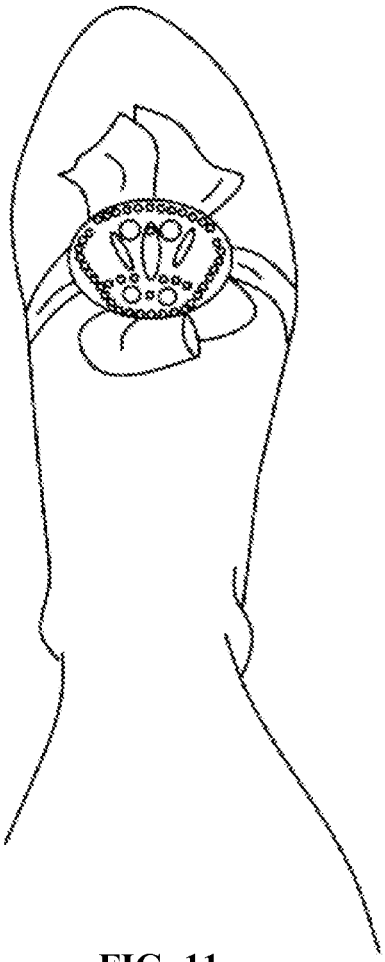
FIG. 11 is the top view of the fourth step of the wrapping method using the first wrap, where the ends of the wrap are decoratively arranged using a brooch.
Figure 12:
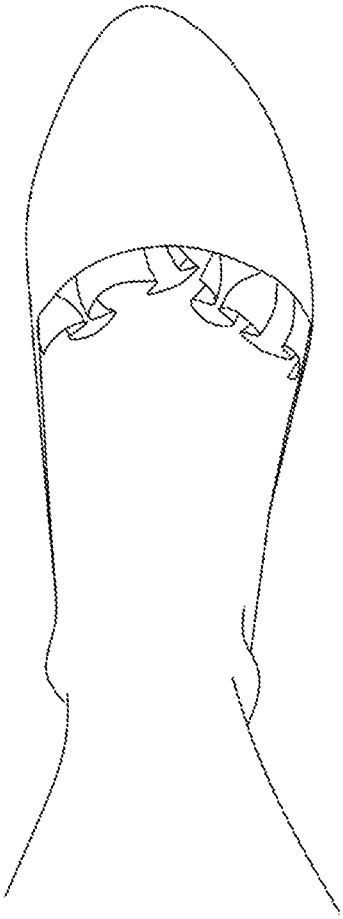
FIG. 12 is the top view of the fourth step of the wrapping method using the first wrap with end sections in the shape of narrow rectangles, where said ends of the wrap are decoratively arranged along the topline of the shoe.
Figure 13:
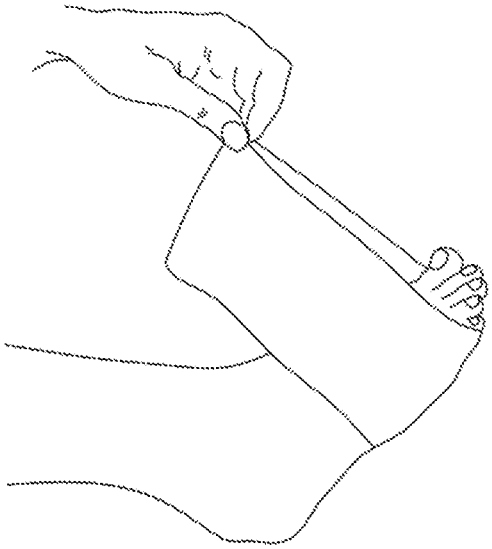
FIG. 13 illustrates the first step of the wrapping method using the second wrap, as the loop is placed around the front part of the user's foot.
Figure 14:
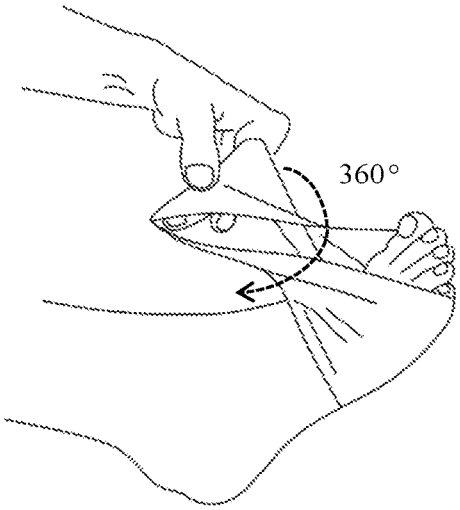
FIG. 14 illustrates how the wrap is twisted 360° to form a double loop in the form of figure eight.
Figure 15:
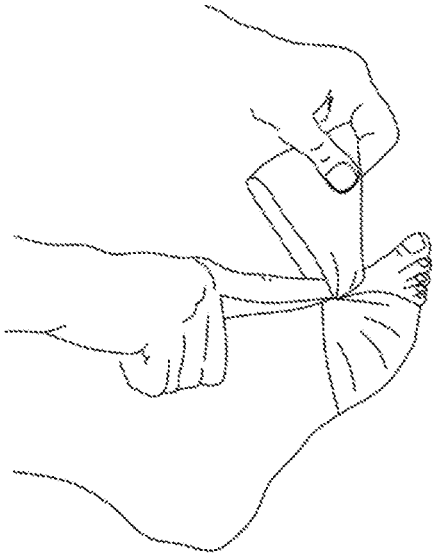
FIG. 15 illustrates the second step of the wrapping method using the second wrap, as one loop of the double loop is wrapped around the user's foot, while the other is free.
Figure 16:
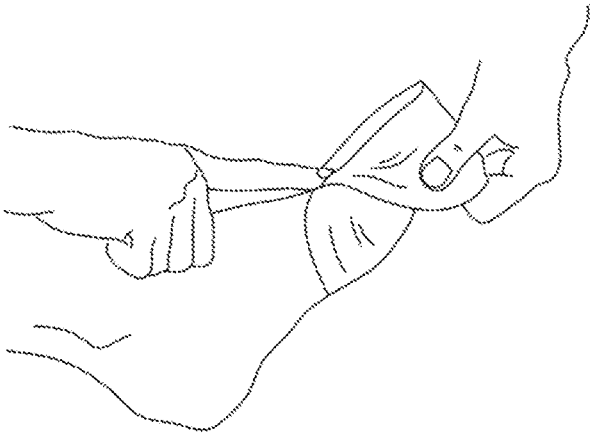
FIG. 16 illustrates the third step of the wrapping method using the second wrap, as one loop of the double loop is wrapped around the user's foot, while the other is being pulled on the toes.
Figure 17:
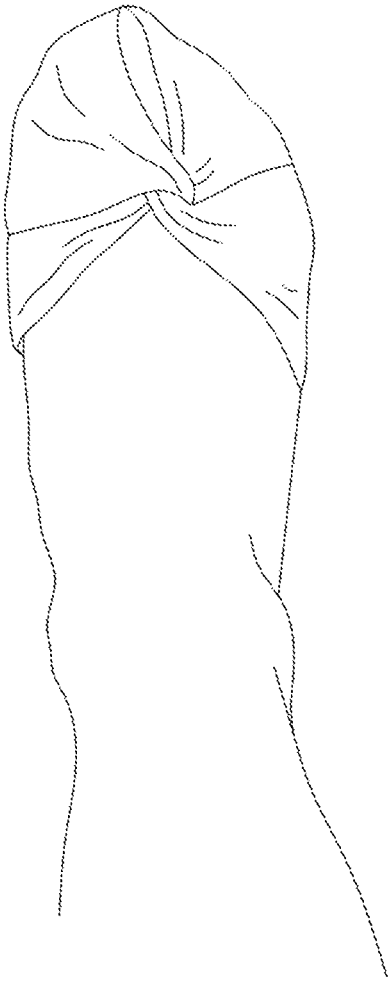
FIG. 17 is the top view of the user's foot wrapped using the second wrap without a shoe.
Figure 18:
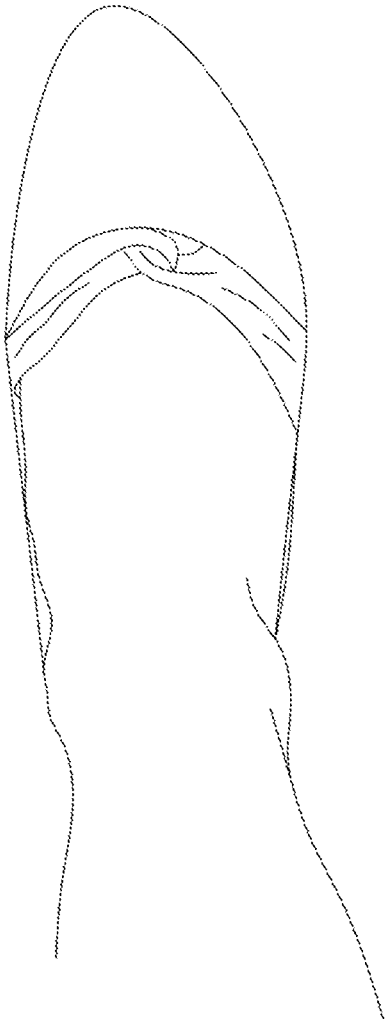
FIG. 18 is the top view of the user's foot wrapped using the second wrap wearing a shoe.

Reference now will be made in detail to the embodiments and advantages of the present utility model.

To achieve the objective of protecting the toes and Metatarsophalangeal (MTP) joint area of user's feet two particularly shaped wraps made of fabric are provided.

In accordance with the first general embodiment of the present utility model, the wrap has a shape of a band which has a mid-section (1) and end sections (2), wherein said mid-section (1) has a width of about ½ of user's foot and the length of at least the circumference of the Metatarsophalangeal (MTP) joint area of user's foot.

End sections (2) may be in the form of an immediate continuation of the mid-section or as extensions representing separate connected pieces of material similar to or different from the material of the mid-section (1). End sections can have various shapes, for example, these can be rectangular, triangular, or in the shape of trapezoids, circles, ovals, or any combination of these shapes. End sections can have even, wavy, or zigzag edges.

The length and shape of the end sections are not limited to the embodiments presented herein and represent an aesthetic aspect of the wrap, therefore these depend on the personal preferences of the user.

In accordance with the second general embodiment of the present utility model, the wrap has a shape of a loop constructed by connecting two ends of a band, wherein said band has a width of about ½ of user's foot and the length of about twice the circumference of the Metatarsophalangeal (MTP) joint area of user's foot. Said loop (3) is used to cover the toes and the Metatarsophalangeal (MTP) joint area of the user's foot.

The first wrap is preferably utilized in accordance with a wrapping method, where the mid-section (1) of the wrap is placed under the front part of the foot, perpendicular to the foot. Then the end sections (2) are crossed at the top of the foot to cover the toes and the Metatarsophalangeal (MTP) joint area of the user's foot. The user then slides the foot into the shoe leaving the end sections (2) of the wrap outside the shoe. The end sections of the wrap are then decoratively tied or arranged.

The second wrap is preferably utilized in accordance with wrapping method, where the loop (3) is placed around the Metatarsophalangeal (MTP) joint area of the foot and twisted 360° to form a double loop in the form of figure eight, where one loop is wrapped around said area of the foot and the second is free. Then, the free loop is arranged around the toe area of the foot. When the shoe is put on, the knot which is formed by twisting the loop remains outside the shoe, close to the topline of the shoe.

Wraps for feet provided herein are made of light fabric such as silk.

Wraps for feet presented herein almost completely cover the front area of the user's foot providing comfort and hygiene to the user's feet when wearing shoes, especially when wearing shoes barefoot.

When made of slick fabric, wraps for feet presented herein may reduce the pain and/or discomfort associated with the process of putting on tight shoes barefoot.

When made of fabric in a color matching the color of the shoe, the wrap minimally affects the appearance of the shoe.

Additionally, the color, pattern, texture and the cut of the band in combination with a specific wrapping method have an aesthetic or ornamental aspect to them and may enhance or complement the look of one's shoes or overall attire.

The band can be cleaned and ironed as often as one prefers to ensure proper hygiene and appearance.

Additionally, the band can be scented or layered with additional protective liners to provide added comfort and/or hygiene.

Wraps for feet presented here can also be wrapped over delicate hosiery thereby providing stylish protection to those.

What is claimed is:

1. A method of wrapping the foot with a wrap comprising a band configured to be wrapped around the toes and the Metatarsophalangeal (MTP) joint area of user's foot, wherein the band has mid and end sections, wherein the mid-section has a width of approximately half the length of user's foot and a length of at least the circumference of the Metatarsophalangeal (MTP) joint area of user's foot, wherein the mid-section is placed under the front part of the foot, perpendicular to the foot, after which said end sections are crossed upward at the top of the foot, after which the shoe is put on leaving the end sections of the wrap outside the shoe to be then decoratively tied.

2. The method of wrapping the foot with the wrap of claim 1, wherein the end sections have a rectangular shape.

3. The method of wrapping the foot with the wrap of claim 1, wherein the end sections are in the shape of trapezoids or triangles attached to the mid-section at the bases.

4. The method of wrapping the foot with the wrap of claim 1, wherein the end sections are in the shape of one or more trapezoids with straight, convex or concave edges attached at their bases.

5. The method of wrapping the foot with the wrap of claim 1, wherein the end sections are in the shape of one or more intersecting circles or ovals.

6. The method of wrapping the foot with the wrap of claim 1, wherein the end sections are in the shape of any combination of intersecting or connected rectangles, trapezoids, triangles, circles, or ovals.

7. The method of wrapping the foot with the wrap of claim 1, wherein the edges of the band are wavy or zigzag.

8. The method of wrapping the foot with the wrap of claim 1, wherein the end sections are identical.

9. The method of wrapping the foot with the wrap of claim 1, wherein the end sections are not identical.

* * * * *